US006571879B1

(12) United States Patent
Bebak et al.

(10) Patent No.: US 6,571,879 B1
(45) Date of Patent: Jun. 3, 2003

(54) SURFACE-ACTUATED RELEASE TOOL FOR SUBMERSIBLE PUMP ASSEMBLIES

(75) Inventors: Kenneth T. Bebak, Tulsa, OK (US); John J. Mack, Tulsa, OK (US); Earl B. Brookbank, Claremore, OK (US); Don C. Cox, Roanoke, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/708,350

(22) Filed: Nov. 8, 2000

(51) Int. Cl.[7] ..... E21B 23/04

(52) U.S. Cl. ..... 166/381; 166/65.1; 166/105; 166/377

(58) Field of Search ..... 166/377, 381, 166/105, 117, 242.6, 65.1

(56) References Cited

U.S. PATENT DOCUMENTS

| | | | | |
|---|---|---|---|---|
| 4,844,511 A | | 7/1989 | Galle et al. | |
| 5,180,014 A | | 1/1993 | Cox | 166/384 |
| 5,191,173 A | | 3/1993 | Sizer et al. | 174/105 |
| 5,269,377 A | | 12/1993 | Martin | 166/385 |
| 5,419,399 A | | 5/1995 | Smith | 166/377 |
| 5,746,582 A | | 5/1998 | Patterson | 417/53 |
| 5,947,198 A | | 9/1999 | McKee et al. | 166/66.4 |
| 5,954,483 A | | 9/1999 | Tetzlaff | 417/360 |
| 6,089,832 A | | 7/2000 | Patterson | 417/360 |
| 6,142,237 A | * | 11/2000 | Christmas et al. | 166/376 |
| 6,213,206 B1 | * | 4/2001 | Bakke | 166/242.7 |
| 6,269,883 B1 | * | 8/2001 | Gissler et al. | 166/340 |

FOREIGN PATENT DOCUMENTS

| | | |
|---|---|---|
| GB | 2342370 A | 4/2000 |
| GB | 2347704 A | 9/2000 |
| WO | WO 97/29270 | 8/1997 |

* cited by examiner

*Primary Examiner*—William Neuder
(74) *Attorney, Agent, or Firm*—Bracewell & Patterson, L.L.P.

(57) ABSTRACT

A submersible pump assembly has a release adapter on a string of coiled tubing. Power cables and a hydraulic capillary tube extend through the coiled tubing to the release adapter where each terminates at a coupling. The release adapter has a locking mechanism that is located in a chamber adjacent to a fishing neck at the upper end of the pump. The locking mechanism has a collet that is latched to the fishing neck. A piston captures the collet against the neck, and is restrained from movement by shear pins. The locking mechanism is actuated from the surface by pumping hydraulic fluid down through the capillary tube to the chamber to stroke the piston downward and shear the pins. When the piston moves, the lower end of the collet releases the fishing neck and is free to be retracted axially upward into the wellbore toward the surface. As the coiled tubing lifts the release adapter away from the fishing neck, tension develops in the wires and tubing until those components detach from their respective couplings. After the unplugged assembly is raised to the surface, a fishing tool may be lowered to retrieve the remaining assembly on the clean and clear fishing neck.

15 Claims, 3 Drawing Sheets

SURFACE-ACTUATED RELEASE TOOL FOR SUBMERSIBLE PUMP ASSEMBLIES

BACKGROUND OF THE INVENTION

1. Technical Field

The present invention relates in general to an improved downhole tool, and in particular to an improved surface-actuated release tool for downhole applications.

2. Description of the Prior Art

Downhole release tools for submersible pump bottom hole assemblies are well known in the art. Unfortunately, some of these devices require remote operation or actuation that requires electrical power to be available at the downhole assembly. Other prior art devices do not provide sufficient means for retrieving the equipment once it is released. Still other devices are limited to configurations that require the motor to be located either above the pump or below the pump. For example, in one prior art release tool (U.S. Pat. No. 5,419,399), a ball is dropped from the surface to pressurize the coiled tubing itself. In another prior art device, the release tool is electrically actuated and requires the use of a wire line cable. In addition, pressure from the drilling medium is also relied upon to help actuate the system. Thus, an improved apparatus and method for releasing a submersible pump bottom hole assembly is needed.

SUMMARY OF THE INVENTION

A submersible pump assembly has a release adapter on a string of coiled tubing. Power cables and a hydraulic capillary tube extend through the coiled tubing to the release adapter where each terminates at a coupling. The release adapter has a locking mechanism that is located in a chamber adjacent to a fishing neck at the upper end of the pump. The locking mechanism has a collet that is latched to the fishing neck. A piston captures the collet against the neck, and is restrained from movement by shear pins.

The locking mechanism is actuated from the surface by pumping hydraulic fluid down through the capillary tube to the chamber to stroke the piston downward and shear the pins. When the piston moves, the lower end of the collet releases the fishing neck and is free to be retracted axially upward into the wellbore toward the surface. As the coiled tubing lifts the release adapter away from the fishing neck, tension develops in the wires and tubing until those components detach from their respective couplings. After the unplugged assembly is raised to the surface, a fishing tool may be lowered to retrieve the remaining assembly on the clean and clear fishing neck.

The foregoing and other objects and advantages of the present invention will be apparent to those skilled in the art, in view of the following detailed description of the preferred embodiment of the present invention, taken in conjunction with the appended claims and the accompanying drawings.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE PREFERRED EMBODIMENT OF THE PRESENT INVENTION

Figure 1:
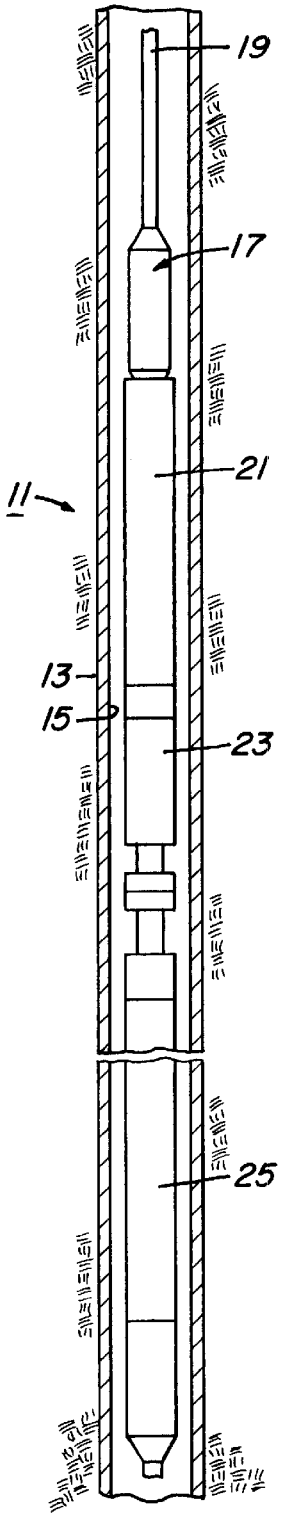
FIG. 1 is a side view of a submersible pump bottom hole assembly constructed in accordance with the present invention and is shown in a well.

Referring to FIG. 1, a side view of a submersible pump bottom hole assembly 11 constructed in accordance with the present invention is shown in a well 13 having a bore 15. Assembly 11 is suspended from a release adapter 17 located at the end of a string of coiled tubing 19 extending into bore 15. In the embodiment shown, a submersible pump 21 is secured to a housing or release adapter 17 and has a seal section 23 at its lower end. A motor 25 is mounted to seal section 23 and extends further down into the well bore.

Figure 2A:
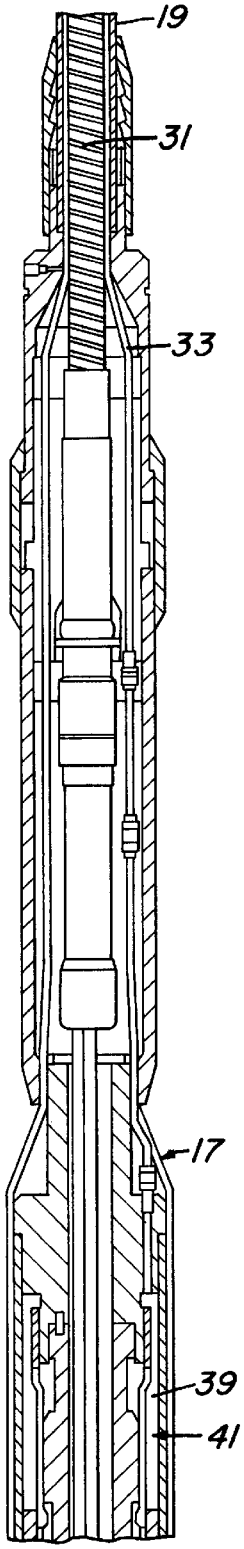
FIG. 2A is a sectional side view of an upper portion of the submersible pump assembly of FIG. 1.
Figure 2B:
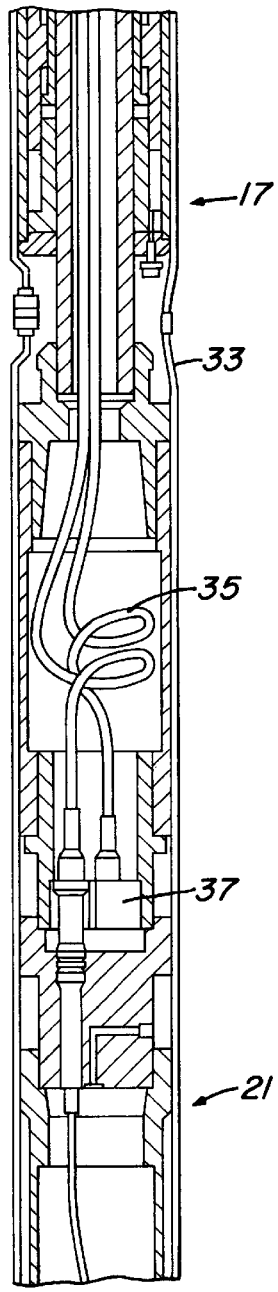
FIG. 2B is a sectional side view of an intermediate portion of the submersible pump assembly of FIG. 1.

As shown in FIGS. 2A and 2B, a power cable 31 and a hydraulic capillary tube 33 extend through coiled tubing 19 and release adapter 17 to pump 21. Power cable 31 contains several electrical wires 35 that interconnect with connectors 37 located at the upper end of pump 21. Capillary tube 33 is hydraulically coupled to an annular chamber 39 containing hydraulic fluid.

Figure 3:
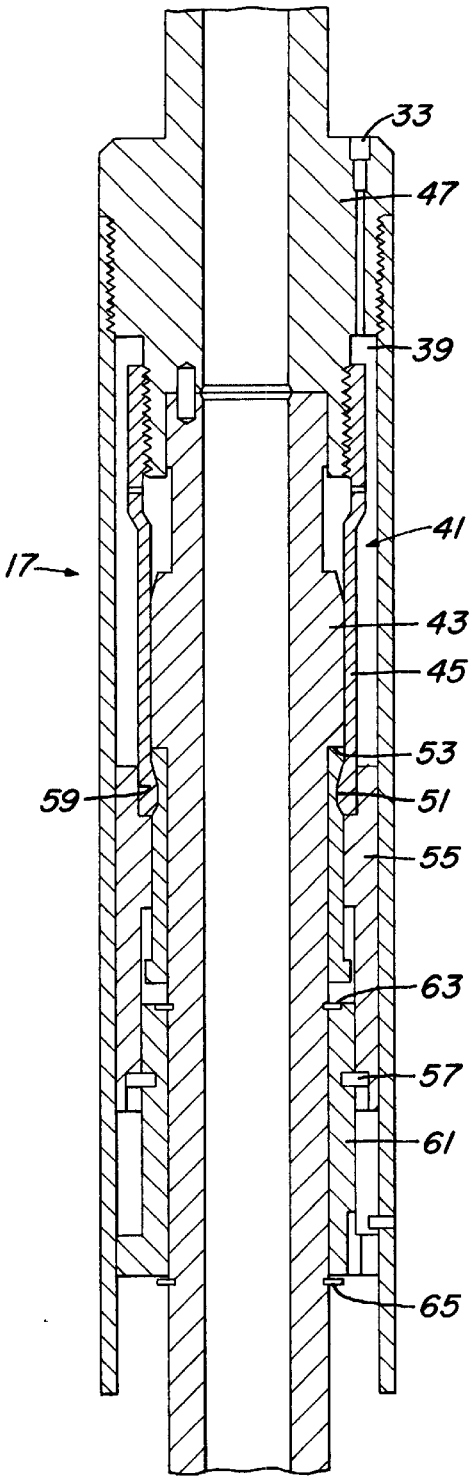
FIG. 3 is an enlarged sectional side view of a release tool in the submersible pump assembly of FIG. 1, and is shown in an engaged position.

As best shown in FIG. 3, a locking means or mechanism 41 is located in chamber 39 and is shown locked to a mandrel or fishing neck 43 at the upper end of pump 21. Locking mechanism 41 comprises a collet 45 that is threaded to and extends from the lower end of a tubular member 47. Collet 45 is latched in an outer profile 51 located on the exterior of neck 43 below a shoulder 53. In FIG. 3, a piston 55 is shown in its upper position and restrained there from downward movement by (preferably) brass shear pins 57. Piston 55has an interior profile 59 at its upper end that captures and abuts the lower end of collet 45 in outer profile 51. Shear pins 57 are mounted in a tubular member 61 that is located below outer profile 51. Tubular member 61 is restrained from axial movement relative to neck 47 by rings 63, 65.

Figure 4:
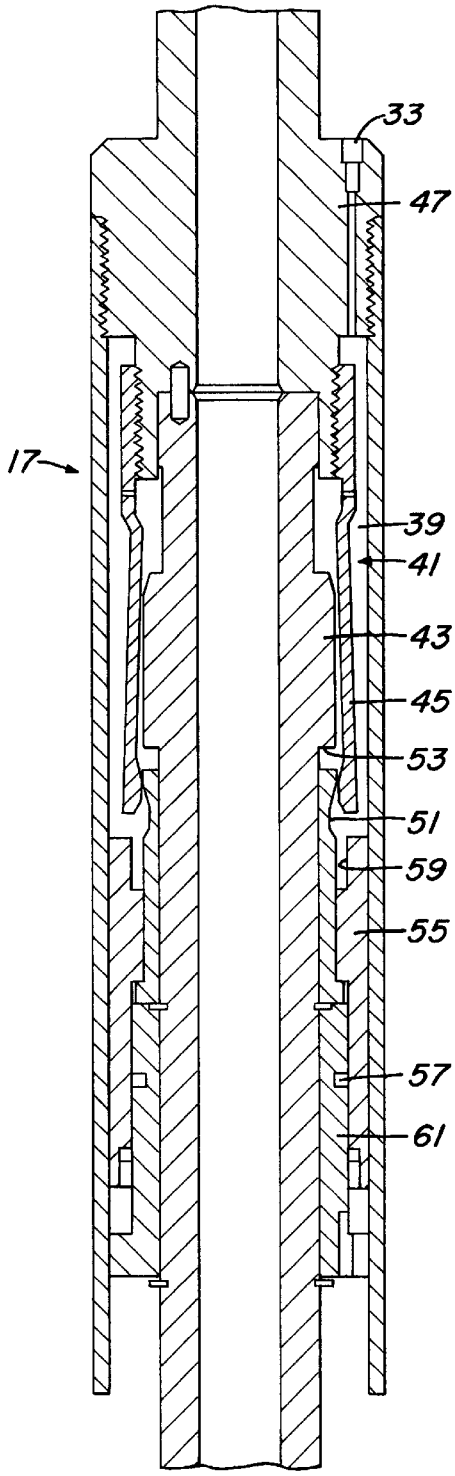
FIG. 4 is an enlarged sectional side view of the release tool of FIG. 3, and is shown in a released position.
Figure 5A:
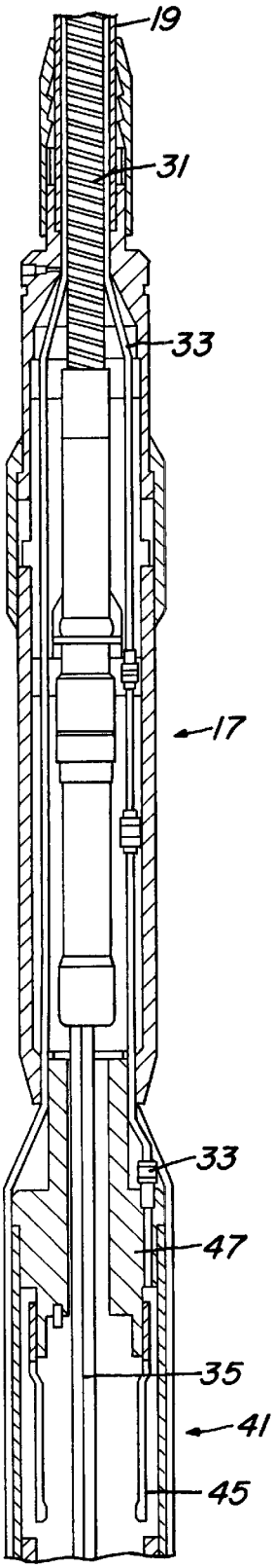
FIG. 5A is an enlarged sectional side view of the release tool of FIG. 3, and is shown partially retracted from the submersible pump assembly.
Figure 5B:
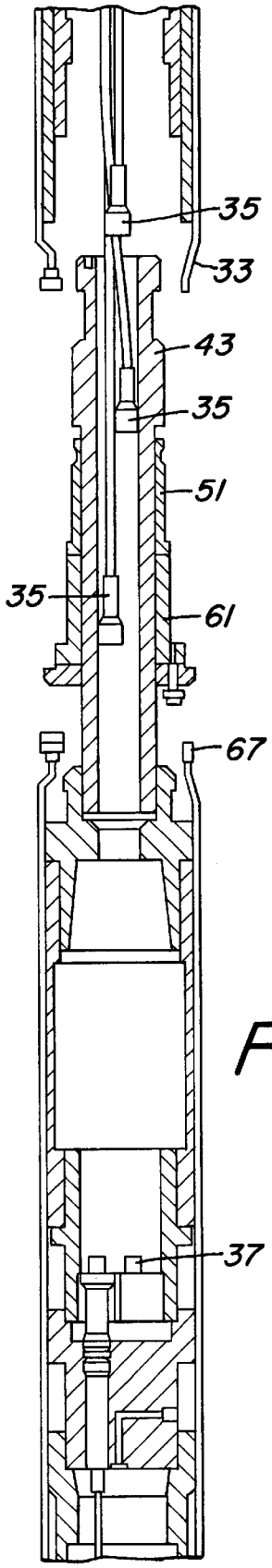
FIG. 5B is an enlarged sectional side view of the release tool of FIG. 3, and is shown fully retracted from the submersible pump assembly.

Referring now to FIG. 4, locking mechanism 41 is actuated from the surface of the well by pumping hydraulic fluid down through capillary tube 33 to chamber 39. When chamber 39 is pressurized, piston 55 strokes downward as shown and shears pins 57. With piston 55 in its lower position, the lower end of collet 45 is released from profile 59 of piston 55 and outer profile 51. Collet 45 springs open or radially outward as shown and is free to be retracted axially upward into the wellbore toward the surface (FIG. 5A). As coiled tubing 19 lifts release adapter 17 and locking mechanism 41 away from fishing neck 43, tension develops in wires 35 and tubing 33 until those components automatically detach or unplug (FIG. 5B) from their respective couplings 37, 67. After the unplugged assembly is raised to the surface, a fishing tool may be lowered to retrieve the remaining assembly on the clean and clear fishing neck 43.

The release tool of the present invention has several advantages including the ability to be activated at the surface to positively release a submersible pump bottom hole assembly from a cable internal coiled tubing system. Once released, the ancillary tubes wires are released or cut to leave a clean, clear fishing neck. Since a separate, completely self-contained, hydraulic capillary line is used for pressure actuation, the release tool is operable even if the coiled tubing is full of cable. Unlike prior art devices, the release tool of the present invention does not rely on electricity to be actuated. Finally, the device may be configured with the motor either on top of or below the pump.

While the invention has been shown or described in only some of its forms, it should be apparent to those skilled in the art that it is not so limited, but is susceptible to various changes without departing from the scope of the invention.

What is claimed is:

1. A downhole tool for a well, comprising:

coiled tubing extending into the well;

a submersible pump assembly suspended on the coiled tubing and having a power cable extending through the coiled tubing and interconnected therewith;

a hydraulically-actuated lock member mounted to the coiled tubing, the lock member having a locked position wherein the submersible pump assembly is secured to the lock member, and a released position wherein the submersible pump assembly is released from the lock member such that the lock member is lifted away from the submersible pump assembly; wherein the lock member is actuated from a surface of the well;

the power cable having a first portion of wires that extends downward into the lock member where they join with a second portion of wires extending upward from the submersible pump assembly;

the lock member being movable to the released position without separating the first and second portions of wires from each other; and wherein upward movement of the coiled tubing after the lock member is in the released position causes tension to be applied to the first portion of wires and separates the first portion of wires from the second portion of wires.

2. The downhole tool of claim 1 wherein the first portion of wires has a selected amount of slack therein so that separation of the first and second portions of wires does not occur until the lock member has lifted a selected distance from the submersible pump assembly.

3. The downhole tool of claim 1, further comprising a hydraulic line extending downward through the coiled tubing and having a first portion that extends downward into the lock member where it joins a second portion of the hydraulic line that extends upward from an actuator of the lock member; wherein the lock member is movable to the released position without separating the first and second portions of the hydraulic line; and upward movement of the coiled tubing after the lock member is in the released position applies tension to the first portion of the hydraulic line and causes the first portion of the hydraulic line to separate from the second portion of the hydraulic line.

4. A downhole tool for a well, comprising:

coiled tubing extending into the well;

a submersible pump assembly suspended on the coiled tubing and having a power cable extending through the coiled tubing and interconnected therewith;

a hydraulically-actuated lock member mounted to the coiled tubing, the lock member having a locked position wherein the submersible pump assembly is secured to the lock member, and a released position wherein the submersible pump assembly is released from the lock member such that the lock member is lifted away from the submersible pump assembly; wherein the lock member is actuated from a surface of the well;

and the submersible pump assembly has a mandrel with an outer profile that engages the lock member.

5. A downhole tool for a well, comprising:

coiled tubing extending into the well;

a submersible pump assembly suspended on the coiled tubing and having a power cable extending through the coiled tubing and interconnected therewith;

a hydraulically-actuated lock member mounted to the coiled tubing, the lock member having a locked position wherein the submersible pump assembly is secured to the lock member, and a released position wherein the submersible pump assembly is released from the lock member such that the lock member is lifted away from the submersible pump assembly; wherein the lock member is actuated from a surface of the well;

and the lock member comprises a collet that is located in a chamber and is movable between the locked and unlocked positions in response to a piston that is stroked from the surface.

6. The downhole tool of claim 5 wherein the piston shears a pin to release the collet to the unlocked position.

7. A downhole tool for a well, comprising:

coiled tubing extending into the well;

a housing secured to a lower end of the coiled tubing and having a chamber;

a submersible pump assembly having a power cable and a hydraulic tube interconnected therewith and extending through the coiled tubing and the housing, the submersible pump assembly also having a mandrel extending upward therefrom;

a hydraulically-actuated lock member mounted to the housing and having a piston located in the chamber, wherein the lock member has a locked position wherein the piston captures the lock member to lock the housing to the mandrel, and a released position wherein the piston releases the lock member such that the housing and the lock member are lifted away from the mandrel and the submersible pump assembly; and wherein the lock member is actuated from a surface of the well.

8. The downhole tool of claim 7 wherein the power cable and the hydraulic tube automatically detach from the submersible pump when the housing is lifted.

9. The downhole tool of claim 7 wherein the lock member comprises a collet that is movable between the locked and unlocked positions in response to the piston being stroked from the surface.

10. The downhole tool of claim 7 wherein the piston shears a pin to release the lock member to the unlocked position.

11. A method of releasing a submersible pump assembly in a well, comprising the steps of:

(a) providing coiled tubing, a submersible pump assembly mounted to the coiled tubing via a lock member and having a power cable interconnected therewith extending through the coiled tubing, the power cable having a first portion of wires extending downward from the coiled tubing into the lock member where they join with a second portion of wires extending upward from the submersible pump assembly;

(b) lowering the submersible pump assembly on the coiled tubing into the well; then (c) hydraulically-actuating the lock member from the surface to a released position wherein the submersible pump assembly is released from the lock member; then (d) pulling upward on the coiled tubing to lift the lock member from the submersible pump assembly, thereby creating tension in the first portion of wires and causing the first portion of wires to separate from the second portion of wires.

12. The method of claim 11 wherein step (a) comprises providing a selected amount of slack in the first portion of wires so that tension is not applied in step (d) until the lock member has been lifted a selected amount.

13. The method of claim 11 wherein step (a) comprises providing a hydraulic line within the coiled tubing and extending a first portion of the hydraulic line downward into the lock member where it joins with a second portion of the hydraulic line that extends upward from an actuator of the lock member; and wherein step (d) further comprises applying tension in the first portion of the hydraulic line by pulling upward on the coiled tubing after the submersible pump assembly has been released from the lock member and causing the first portion of the hydraulic line to separate from the second portion of the hydraulic line.

14. A method of releasing a submersible pump assembly in a well, comprising the steps of:

(a) providing coiled tubing, a submersible pump assembly mounted to the coiled tubing via a lock member and having a power cable interconnected therewith extending through the coiled tubing;

(b) lowering a submersible pump assembly on the coiled tubing into the well; and then (c) hydraulically-actuating the lock member from the surface to a released position wherein the submersible pump assembly is released from the lock member such that the lock member is lifted away from the submersible pump assembly; and wherein step (c) comprises moving a collet to release the submersible pump assembly in response to stroking a piston adjacent to the lock member from the surface.

15. The method of claim 14, further comprising the step of shearing a pin with the piston to release the collet to the unlocked position.

* * * * *